US007181942B2

(12) United States Patent
Yost et al.

(10) Patent No.: US 7,181,942 B2
(45) Date of Patent: Feb. 27, 2007

(54) DEVICE AND METHOD FOR CONNECTIONS MADE BETWEEN A CRIMP CONNECTOR AND WIRE

(75) Inventors: William T. Yost, Newport News, VA (US); K. Elliott Cramer, Yorktown, VA (US); Daniel F. Perey, Yorktown, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 76 days.

(21) Appl. No.: 10/943,649

(22) Filed: Sep. 9, 2004

(65) Prior Publication Data

US 2005/0193792 A1 Sep. 8, 2005

Related U.S. Application Data

(60) Provisional application No. 60/550,740, filed on Mar. 2, 2004.

(51) Int. Cl.
*B21D 39/00* (2006.01)

(52) U.S. Cl. ..... 72/17.2; 72/16.2; 72/16.4; 72/17.3; 72/31.01; 29/705; 29/720; 73/587; 73/588

(58) Field of Classification Search ..... 72/54, 72/31.01, 31.1, 16.2, 16.4, 17.3; 73/587–589, 73/618, 624, 628, 633; 29/705, 720
See application file for complete search history.

(56) References Cited

U.S. PATENT DOCUMENTS

| | | | | |
|---|---|---|---|---|
| 3,157,075 | A | 11/1964 | Filia et al. | |
| 3,292,413 | A * | 12/1966 | Falcioni | 72/377 |
| 4,062,227 | A | 12/1977 | Heyman | |
| 4,385,515 | A | 5/1983 | Link et al. | |
| 5,046,241 | A | 9/1991 | Ricard | |
| 5,092,026 | A | 3/1992 | Klemmer et al. | |
| 5,297,435 | A * | 3/1994 | Papazian | 73/597 |
| 5,814,728 | A * | 9/1998 | Okawa et al. | 73/587 |
| 6,196,062 | B1 | 3/2001 | Wright et al. | |
| 6,393,924 | B1 * | 5/2002 | Eder et al. | 73/850 |
| 6,418,769 | B1 | 7/2002 | Schreiner | |
| 6,553,803 | B1 * | 4/2003 | Heingartner et al. | 72/31.1 |

* cited by examiner

*Primary Examiner*—Daniel C. Crane
(74) *Attorney, Agent, or Firm*—Robin W. Edwards; Kurt G. Hammerle

(57) ABSTRACT

An ultrasonic device and method obtains desirable crimp connections between a crimp connector and a wire, or bundle of wires, by assessing the desirability of connections made in a wire-to-wire connection and in other situations where two materials with good acoustic propagation characteristics are joined together via deformation. An embodiment of the device as a crimping tool comprises a compressing means, pulse-generating circuitry, at least one ultrasonic transmitting transducer, at least one ultrasonic receiving transducer, receiving circuitry, and a display. The user may return to a previously crimped connection and assess the desirability of the connection by compressing the device about the connection, sending an acoustic signal through the crimp, and comparing the received signal to a signal obtained from known desirable connections.

27 Claims, 15 Drawing Sheets

DEVICE AND METHOD FOR CONNECTIONS MADE BETWEEN A CRIMP CONNECTOR AND WIRE

CROSS-REFERENCE TO RELATED APPLICATION

This application claims the benefit of U.S. Provisional Patent Application Ser. No. 60/550,740 filed on Mar. 2, 2004, the contents of which is incorporated herein by reference in its entirety.

ORIGIN OF THE INVENTION

The invention described herein was made by employees of the United States Government and may be manufactured and used by or for the Government for governmental purposes without the payment of any royalties thereon or therefore.

BACKGROUND OF THE INVENTION

The invention relates generally to a crimping tool, and more specifically to a crimping tool and method that uses acoustic signals to determine the desirability of connections between a crimp connector and a body such as a wire or bundle of wires.

BRIEF SUMMARY OF THE INVENTION

An ultrasonic device and method obtains desirable connections between a crimp connector and a wire, hereafter known as crimp connections, for situations where two materials with good acoustic propagation characteristics are joined together via deformation. The crimping device comprises a compressing means, pulse-generating circuitry, at least one ultrasonic transducer means, receiver circuitry, and a display.

The transducer means comprises a transmitter and a receiver that are coupled to a crimp compressing means such that pulsed electrical signals applied to the transmitter are converted to acoustic waves that propagate into the compressing means and through the materials being crimped. The acoustic waves then travel to the receiver where they are converted to electrical signals. These electrical signals are communicated to the operator of the crimp compressing means via the display.

This embodiment enables comparison of the communicated electrical signals with signals that have been obtained for previous crimps that were determined to be desirable connections through destructive testing. A desirable connection is one where the applied compression produces sufficient stresses so that many body-to-connector connections are established. The permanent deformation of the crimp connector should be sufficiently large so as to assure substantial residual stresses after the release of the compressing means thereby maintaining good atom-to-atom intimacy between the connector and the body. If the communicated electrical signals do not match the signals of a desirable crimp connection, then motion of the compressing means continues until a match with a predetermined signal is made. Once the communicated signals do match that of a desirable crimp, then motion of the compressing means is stopped because a desirable crimp connection has been made. If no such match is ever achieved, the crimped connection is disposed of, and a new crimp connector should be used on a fresh section of wire.

In another embodiment of the invention, the electrical signal generated by the receiving transducer for a predetermined and desirable crimp connection is stored in an electronic databank and compared to the communicated electrical signal using computational circuitry. The computational circuitry determines whether the received electrical signal approximates the predetermined crimp electrical signature within certain parameters. The operator is then able to determine when to stop compressing the crimping tool by observing a display. In one embodiment, electronic circuitry displays a red light when the communicated electrical signal does not match the predetermined signal within the outlined parameters and displays a green light when the communicated signal does match the predetermined signal.

The same device can be used to determine the desirability of a crimp connection after its formation. The device is positioned such that the compressing means aligns with the deformation pattern on the compressed crimp connector. An ultrasonic coupling agent is applied to the compressed crimp connector and body, hereinafter called the crimp connection. The compressing means of the device is brought together in order to apply pressure to the crimp connection, but not so much pressure that additional deformation occurs. An acoustic signal is then sent through the crimp connection as outlined above. The acoustic signal is then received by a receiving transducer and converted to an electrical signal. The received signal is then compared with the signal generated when the crimp connection was originally made, compared with signals of crimp connections verified to be desirable through destructive testing, or a combination of these two comparisons to determine the desirability of the formed crimp connection.

DETAILED DESCRIPTION OF THE INVENTION

Figure 1:
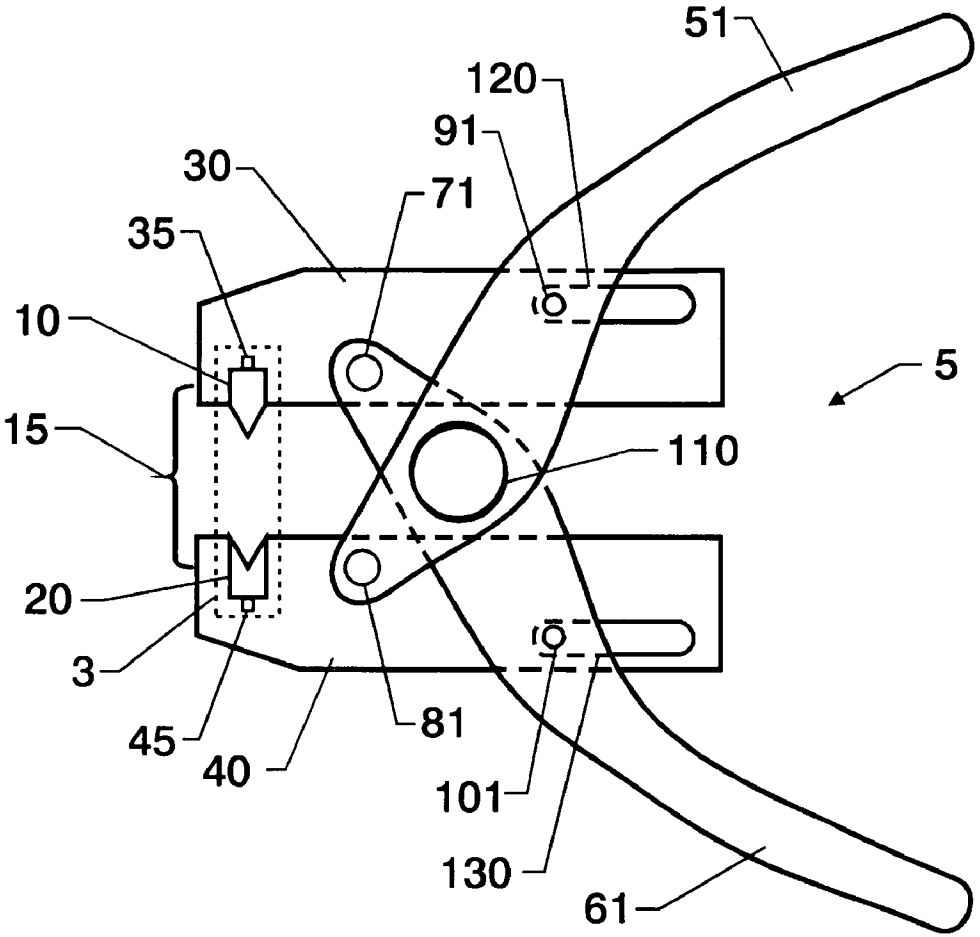
FIG. 1 is a side view of a crimping tool in accordance with one embodiment of the present invention.
Figure 2:
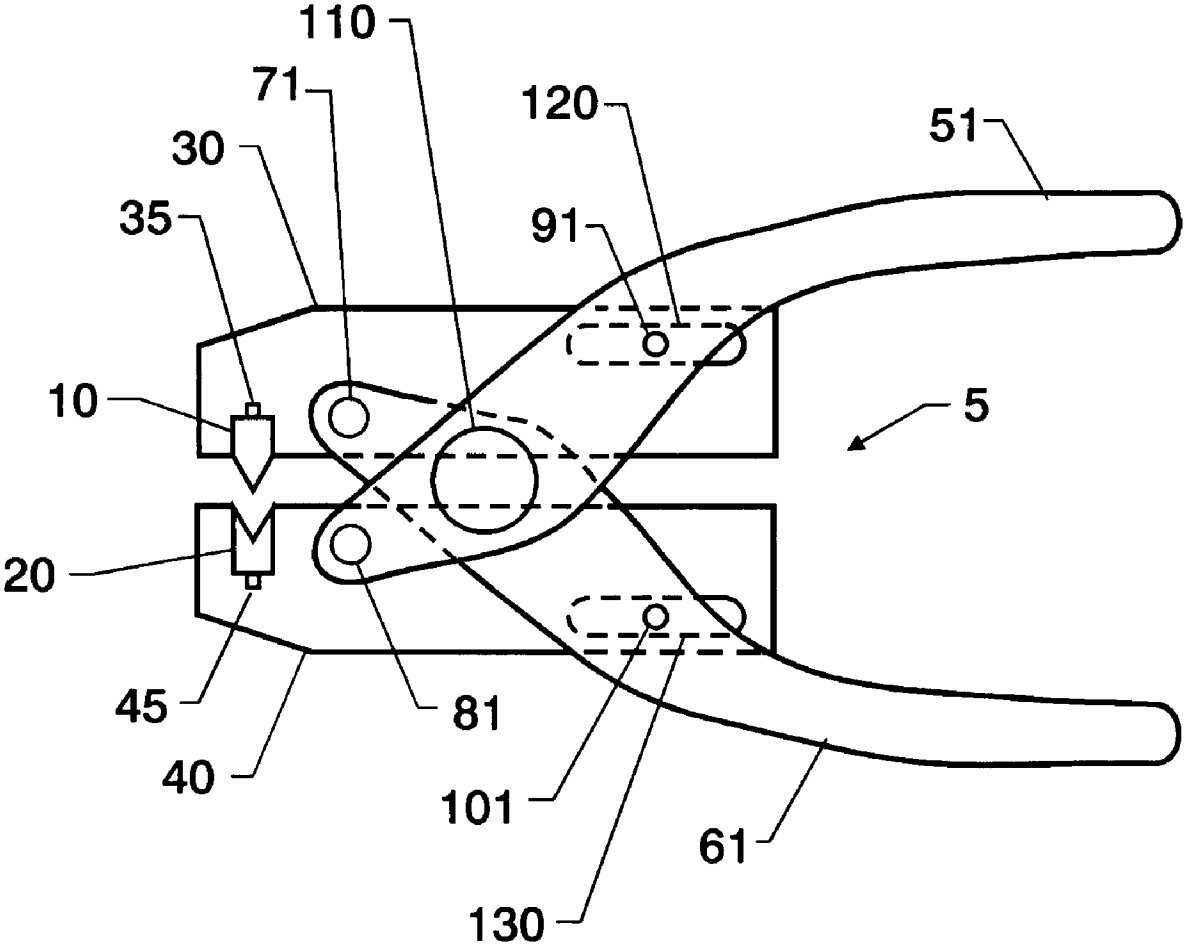
FIG. 2 is a side view of the crimping tool of FIG. 1 illustrating the compressing means in a compressed position.

Referring now to the drawings in detail, wherein like numerals indicate like elements throughout the drawings, FIGS. 1 and 2 show a crimping tool in accordance with an embodiment of the present invention, designated generally by the numeral 5. A pair of handles 51 and 61 are connected to, and allowed to rotate about, a coaxial pivot 110. Jaws 30 and 40 are positioned opposite one another, with handle 51 being pivotally attached to jaw 40 at 81 and handle 61 being pivotally attached to jaw 30 at 71. Guide pins 91 and 101 are secured on handles 51 and 61 respectively. Jaws 30 and 40 are provided with elongated slots 120 and 130 respectively, which extend longitudinally therealong and are disposed to engage guide pins 91 and 101. Closure of handles 51 and 61 causes the handles to rotate about pivot 110 and effects closure of the jaws 30 and 40. The pivot mounting of the jaws on the handles and cooperation of guide pins 91 and 101 with slots 120 and 130 respectively causes the jaws to maintain orientation to one another. FIG. 1 illustrates the jaws 30 and 40 in the open position and FIG. 2 shows the jaws 30 and 40 in a partially compressed position.

As illustrated in FIGS. 1 and 2, crimping tool 5 includes compressing means 15, which comprises a punch 10 and an anvil 20. The punch and anvil as illustrated here is one example showing the structure of the compressing means; other structures providing the function of compressing would be within the scope of the invention.

Figure 3:
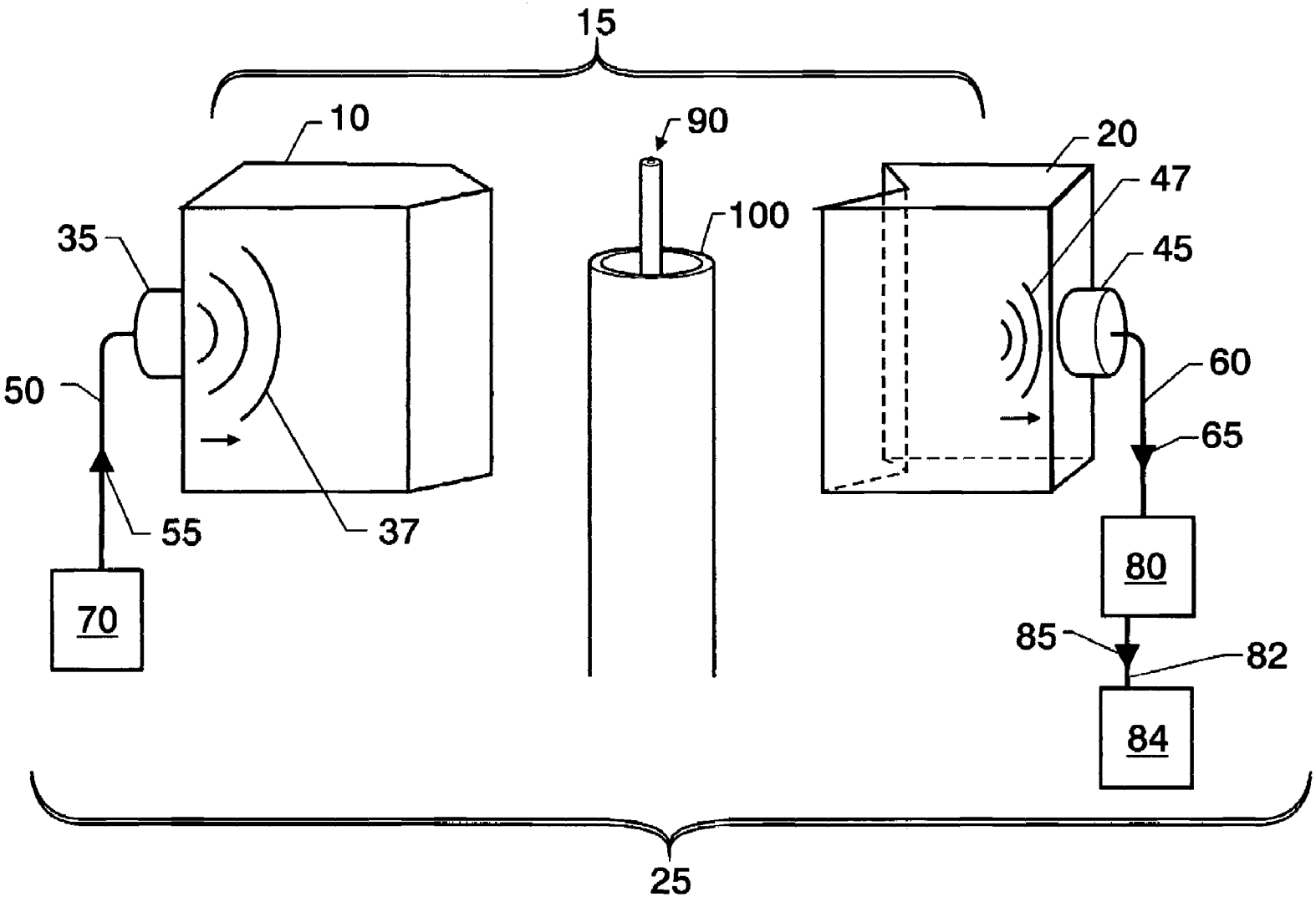
FIG. 3 is an isolated and simplified perspective view of the area outlined in FIG. 1 by dotted line 3 showing an arrangement of the ultrasonic components and related circuitry in accordance with one embodiment of the invention.

FIG. 3 is a representational view of the punch 10 and anvil 20 as seen from the dotted line 3 of FIG. 1 and shows how the compressing means 15 engages a wire 90 and a crimp connector 100. Although wire 90 has been illustrated as a single strand of wire, it may also comprise a plurality of strands or bundle of wires combining to form one body. Specifically, as the punch 10 and anvil 20 are brought together, they deform the crimp connector 100 about the wire 90 to provide both mechanical and electrical connections.

Once the punch 10 and anvil 20 begin compressing the crimp connector 100, an electrical signal 55, in the form of a voltage spike, is sent from a pulse-generating circuit 70 through an electrical connection 50 to a transmitting transducer 35. The electrical signal 55 activates the transmitting transducer 35 ultrasonically coupled to a non-operative surface of the punch 10, which then transduces the electrical signal 55 into an acoustic signal 37. Acoustic signal 37 may be in the ultrasonic frequency range, which is understood by the skilled artisan to be the range of frequencies above the audio-frequency range. The acoustic signal 37 then travels through the punch 10 and through the crimp connector 100, through any contacts made by the compression between the crimp connector 100 and the wire 90, through the wire 90, through the opposing side of the crimp connector 100, through the anvil 20 and to a receiving transducer 45 ultrasonically coupled to a non-operative face of the anvil 20. This method of sending an acoustic signal from one side of the apparatus and receiving it at the opposing side is called a pitch-catch technique. The receiving transducer transduces the acoustic signals 47 received in the anvil 20 into an electrical signal 65 which is sent via an electrical connection 60 to receiver circuitry 80 for processing including amplification and analysis. An electrical signal 85 is the output of the receiver circuitry 80 and it is sent via electrical connection 82 to a display 84.

As the applied pressure increases and the crimp connector 100 deforms around the wire 90, a number of points of contact, or asperities, between the wire 90 and the crimp connector 100 result. These points of contact enable increased ultrasonic transmission from the transmitting transducer 35 to the receiving transducer 45. The number of pathways for ultrasonic transmission through the crimp connector 100 and wire 90 correspond to the number of pathways for electrical conduction. Once deformation of the connector 100 around the wire 90 is complete, a crimp connection between the connector 100 and the wire 90 is formed.

One way of determining the desirability of the crimp connection (i.e. the mechanical strength and the amount of electrical transmission between the wire and the connector) is for the user to first make a series of test crimp connections using wire and crimp connectors similar to the ones to be used later for a desired application. The user records the output associated with each test crimp connection. The test crimp connections are then submitted to electrical testing and mechanical destructive pull testing to determine their electrical and mechanical characteristics. The recorded outputs associated with connections determined to be of desirable quality via testing are noted for future comparison with the outputs of the crimping tool generated later during its desired application. This technique thereby allows the user to assess the desirability of the crimp connection while it is being made. The comparison to be performed between the desired value and measured value during use of the crimping tool may be done by the operator of the tool, or it can be accomplished using electrical circuitry 80.

Because an acoustic signal may be sent through a crimp by several different methods, and because a wire and a crimp connector may be compressed by several methods, the foregoing and following descriptions are considered exemplary rather than exclusive. For example, FIGS. 4–7 will describe various embodiments employing a pitch-catch technique for the acts of transmitting the acoustic signal and of receiving the acoustic signal for a crimping tool using a punch and an anvil. FIGS. 8–11 will describe various embodiments employing the pulse-echo technique for the acts of transmitting and receiving acoustic signals, again for a tool using a punch and anvil. FIGS. 13–17 indicate various embodiments employing both the pitch-catch and pulse-echo techniques for embodiments employing four compressing members.

Figure 4:
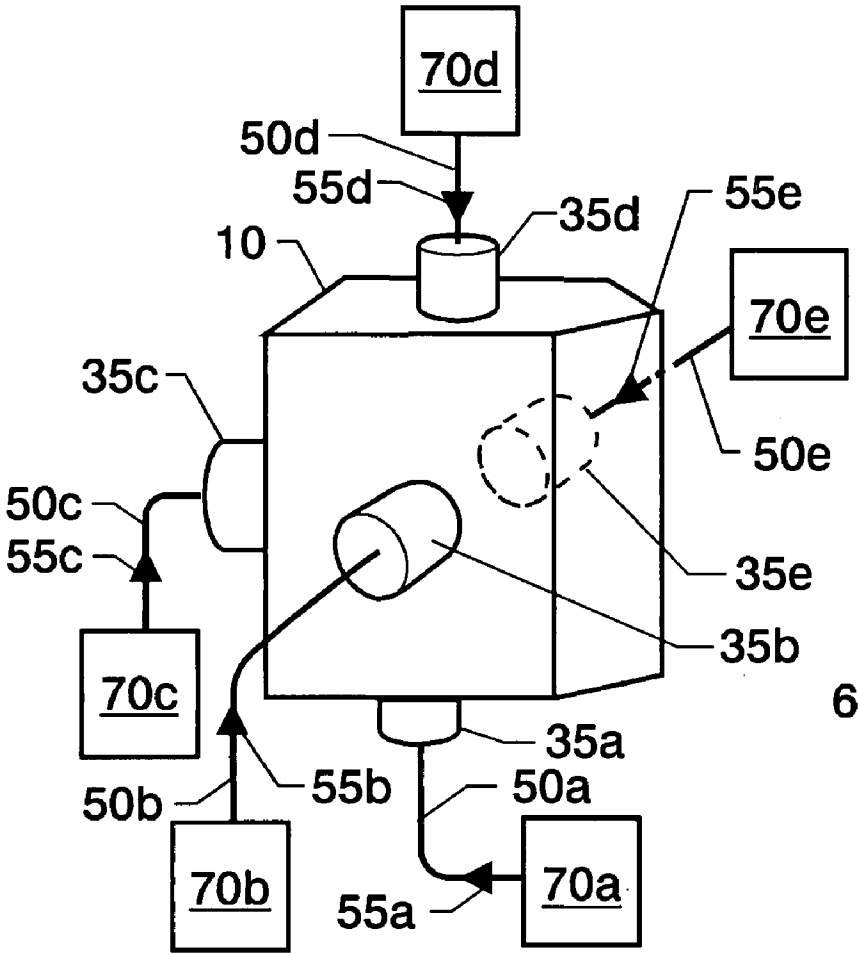
FIG. 4 is a perspective view of a punch member of the compressing means and some arrangements of the ultrasonic components and related circuitry in accordance with another embodiment of the invention.

Referring now to FIG. 4, the transmitting transducer 35 may be positioned on any non-operative (i.e., non-compressing) face of the punch 10. Additionally, the device may comprise multiple transmitting transducers 35*a*–*e*. Multiple independent pulse-generating circuits 70*a*–*e* may all independently send electrical signals 55*a*–*e* through electrical connections 50*a*–*e*, respectively, to their corresponding transmitting transducers 35*a*–*e* or may be connected in a manner that allows for one set of pulse-generating circuitry 70 to send a respective electrical signal 55 to all the transmitting transducers simultaneously (not shown).

Figure 5:
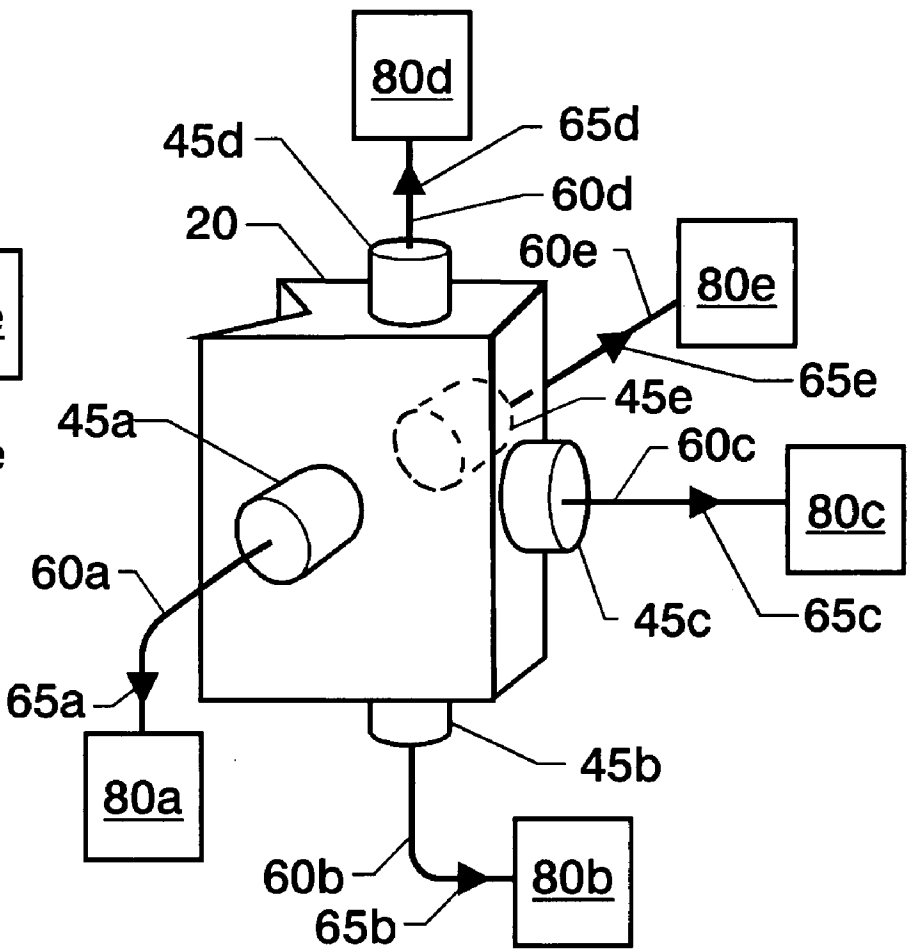
FIG. 5 is a perspective view of an anvil member of the compressing means and some arrangements of the ultrasonic components and related circuitry in accordance with another embodiment of the invention.

Referring to FIG. 5, the receiving transducer 45 may be positioned on any non-operative (i.e., non-compressing) face of the anvil 20. Additionally, the device may comprise multiple receiving transducers 45*a*–*e*. The multiple receiving transducers 45*a*–*e* may all be connected separately via their respective electrical connections 60*a*–*e* to separate receiving circuitry 80*a*–*e*, respectively, or transducers 45*a*–*e* may all be connected in a manner that allows for one set of receiver circuitry 80 (not shown) to process the respective electrical signals 65*a*–*e* sensed by the receiving transducers 45*a*–*e* simultaneously.

Figure 6:
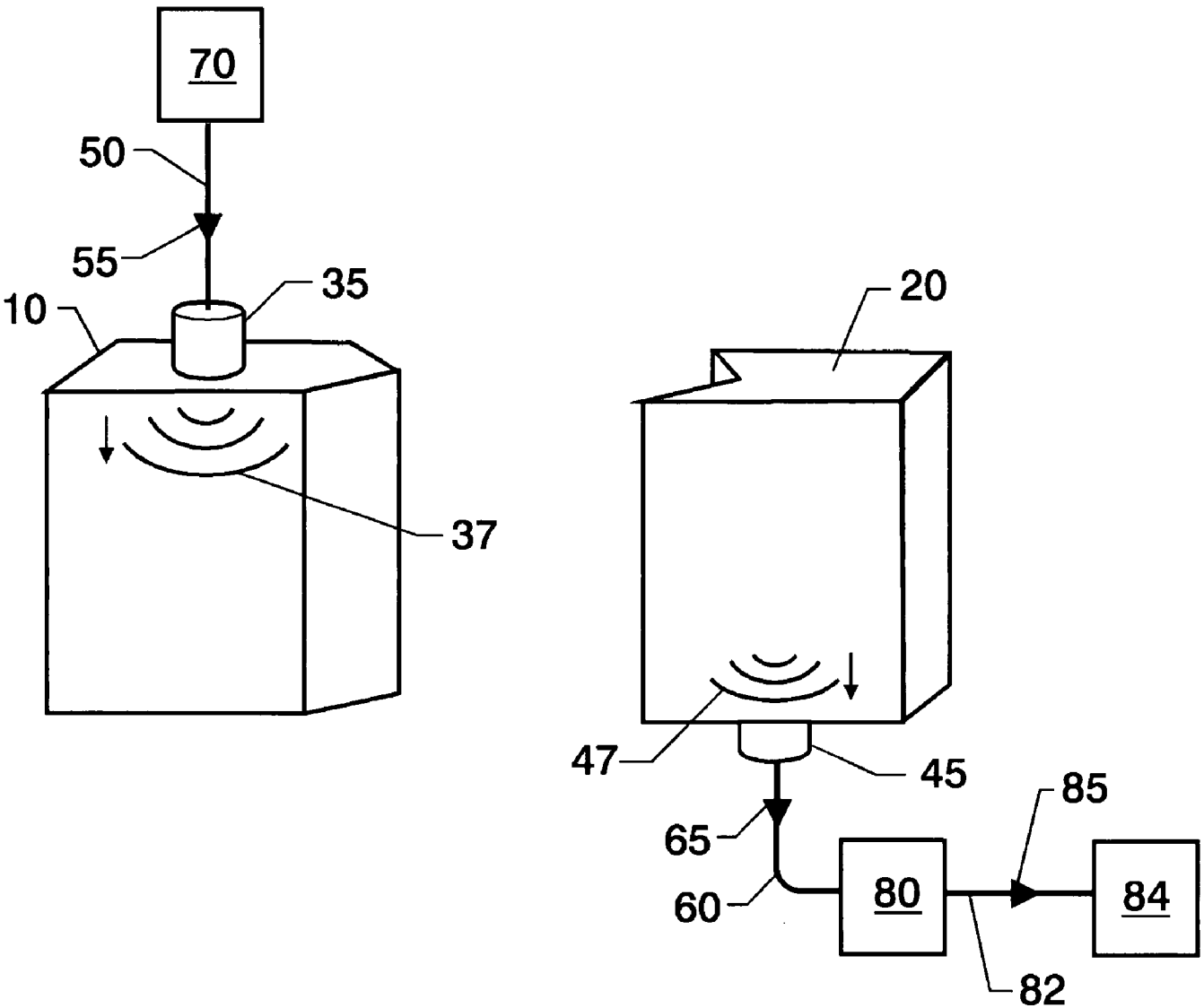
FIG. 6 is a perspective view of the compressing means showing an arrangement of the ultrasonic components and related circuitry.
Figure 7:
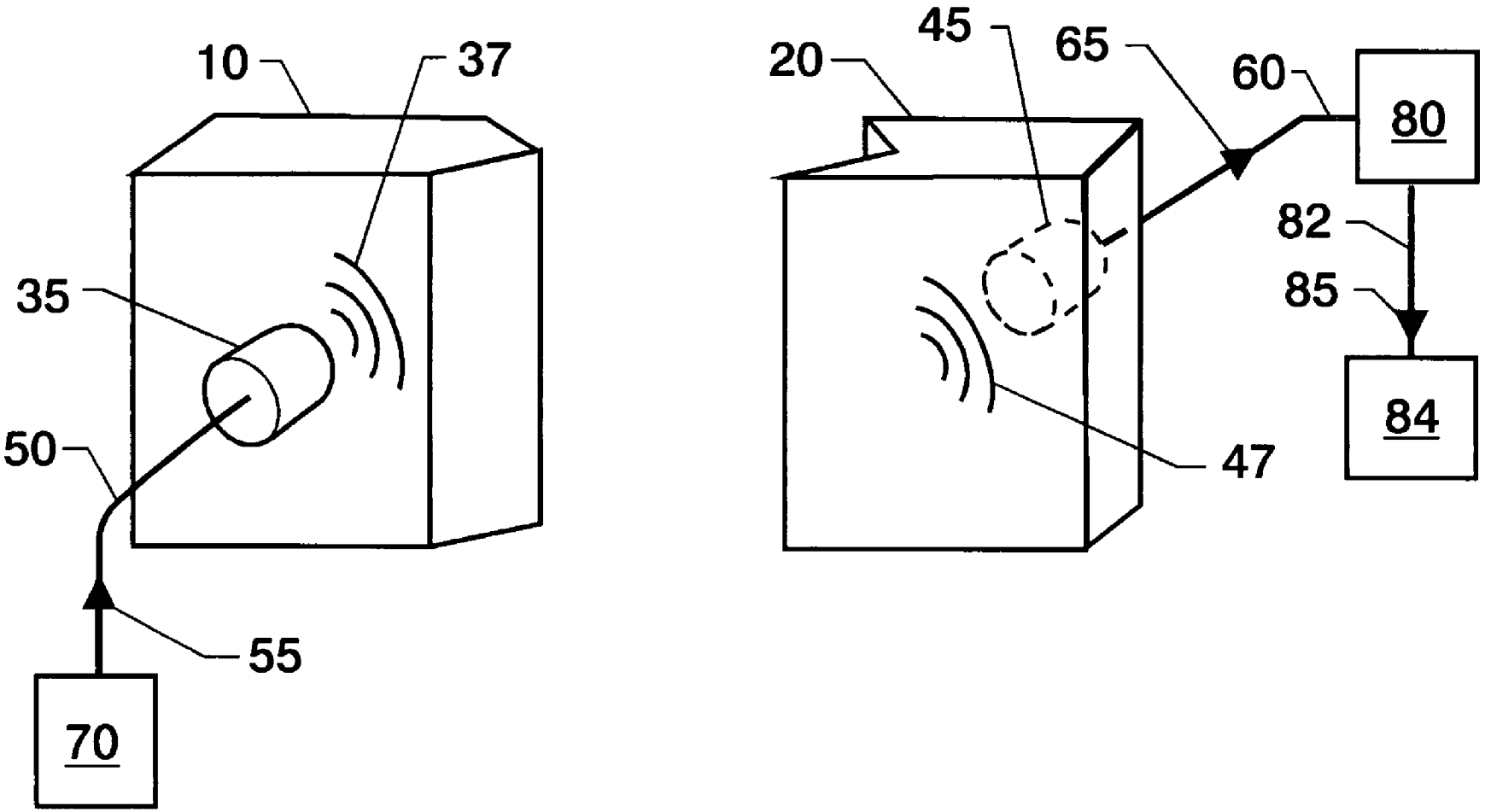
FIG. 7 is a perspective view of the compressing means showing another arrangement of the ultrasonic components and related circuitry.

In another embodiment, the transmitting transducer 35 and the receiving transducer 45 are not positioned directly opposite one another such that the path of travel of the acoustic signal 37 propagates directly onto the receiving transducer as illustrated in FIG. 3. Instead, as shown in FIGS. 6 and 7, the transmitting transducer 35 and receiving transducer 45 may be positioned such that acoustic signals 37 are sent transversely across the wire 90 and crimp connector 100 rather than substantially in a straight line. Nevertheless, such positioning still employs a pitch-catch technique for transmitting and receiving the acoustic signal.

Even though the illustrations to this point have consistently shown the transmitting transducer 35 on the punch 10 and the receiving transducer 45 on the anvil 20, the positioning of the transmitting transducer 35 and the receiving transducer 45 may be vice versa, (i.e., the transmitting transducer 35 may be positioned on the anvil 20 and the receiving transducer 45 may be positioned on the punch 10).

Figure 8:
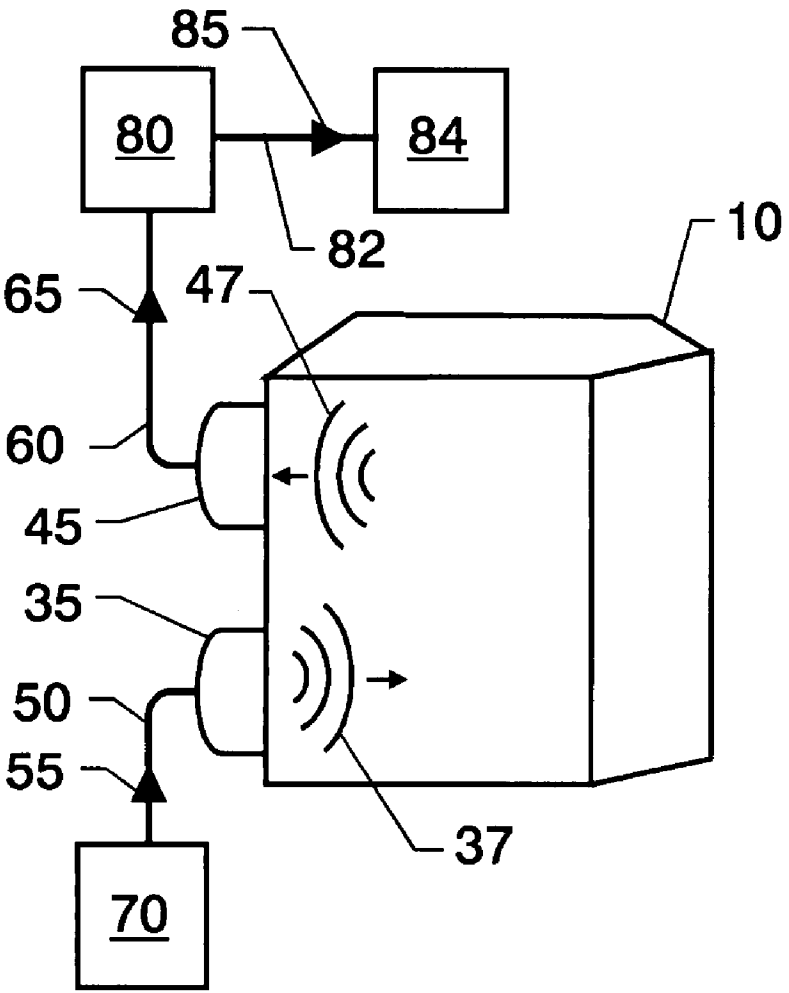
FIG. 8 is a perspective view of a punch member of the compressing means and some arrangements of the ultrasonic components and related circuitry.

Another example of positioning for the transmitting transducer 35 and receiving transducer 45 is illustrated in FIG. 8, where both the transmitting and receiving transducers, 35 and 45 respectively, are located on the punch 10. In such a configuration, an acoustic signal 37 is sent from the transmitting transducer 35 through the punch 10 and through the connections between the crimp connector 100 and wire 90, and to the anvil 20. The acoustic signal 47 then bounces or echoes back from the anvil 20, travels once more through the connections between the crimp connector 100 and the wire 90, and is received by the receiving transducer 45. This method for sending an acoustic signal from one end of the apparatus, having it travel through the crimp connection, bounce back from the opposing compressing means and to travel back through the crimp connection, and then having it received at the same end of the apparatus as it was sent from is called a pulse-echo technique. Once at the receiving transducer the acoustic signal is converted to an electrical signal 65 which is sent via electrical connection 60 to the receiver circuitry 80. After amplification and analysis of signal 65, another electrical signal 85 is sent via electrical connection 82 for display by device 84.

Figure 9:
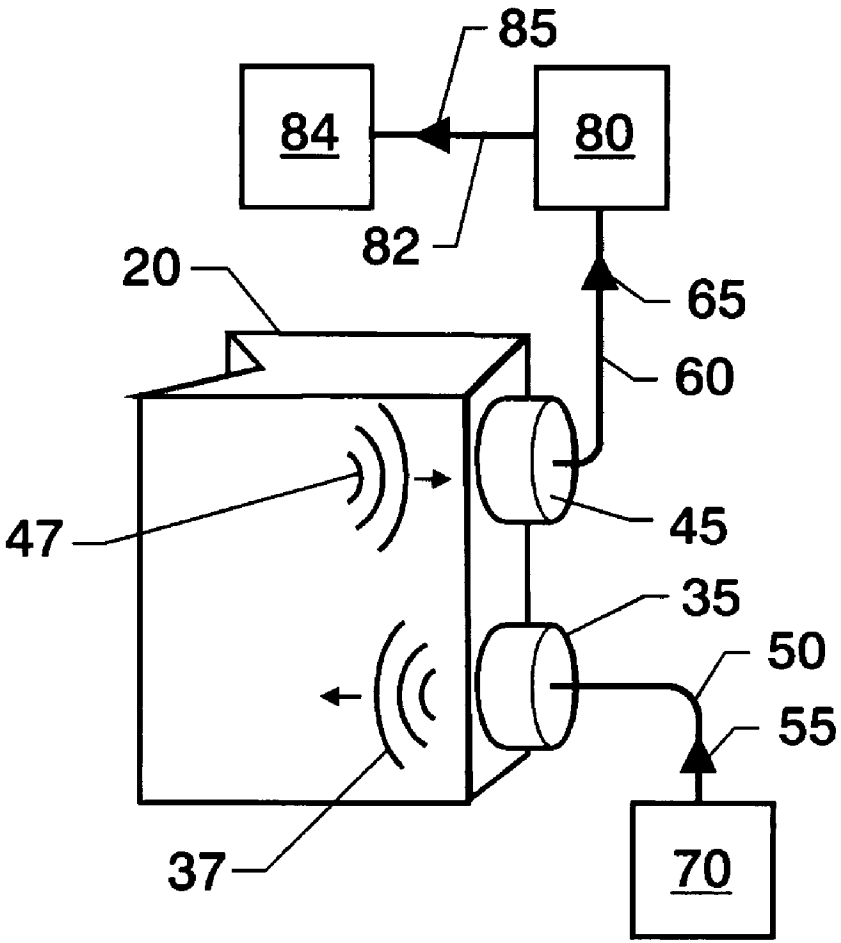
FIG. 9 is a perspective view of an anvil member of the compressing means and some arrangements of the ultrasonic components and related circuitry.

Another example of positioning of the transmitting transducer 35 and receiving transducer 45 is illustrated in FIG. 9, where both the transmitting and receiving transducers, 35 and 45 respectively, are located on the anvil 20. In such a configuration, a pulse-echo technique would be used to send an acoustic signal 37 from the transmitting transducer 35 through the anvil 20 and through the connections between the crimp connector 100 and wire 90, and to the punch 10. The acoustic signal 47 would then bounce or echo back from the punch 10, travel once more through the connections between the crimp connector 100 and the wire 90, be received by the receiving transducer 45, and be converted to an electrical signal 65 sent via electrical connection 60 to the receiver circuitry 80. After analysis and amplification of signal 65, another electrical signal 85 is sent via electrical connection 82 to be displayed by device 84.

Figure 11:
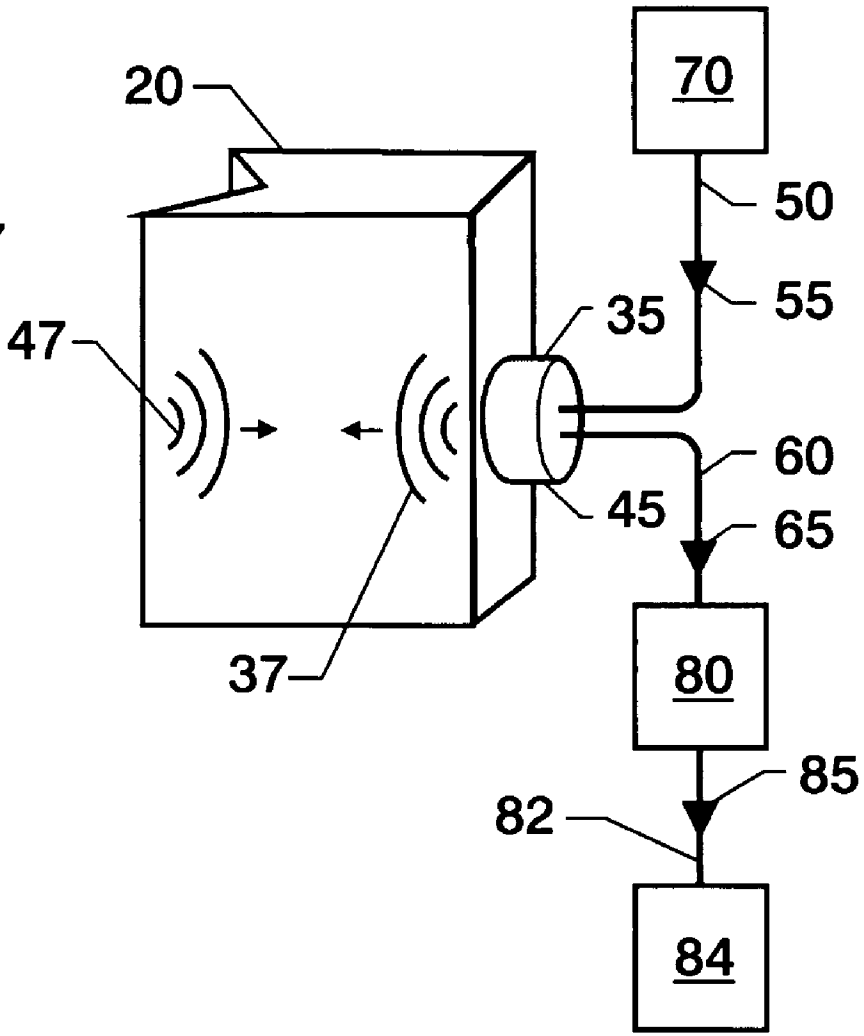
FIG. 11 is a perspective view of a punch member of the compressing means and some arrangements of the ultrasonic components and related circuitry in a pulse-echo configuration.
Figure 10:
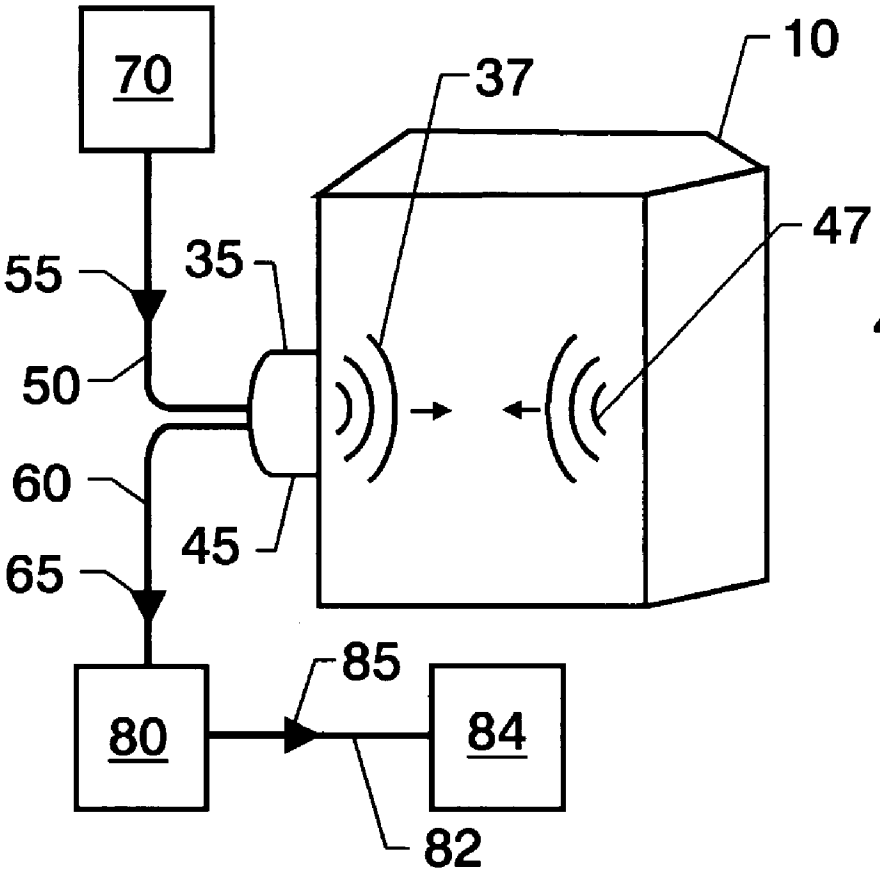
FIG. 10 is a perspective view of a punch member of the compressing means and some arrangements of the ultrasonic components and related circuitry in a pulse-echo configuration.

In another embodiment, rather than having two separate transducers 35 and 45, the device may use one ultrasonic transducer that functions as both the transmitting transducer 35 and the receiving transducer 45. For example, FIG. 10 shows one transducer positioned on punch 10 for transmitting acoustic signal 37 and receiving acoustic signal 47. FIG. 11 shows one transducer positioned on anvil 20 for transmitting acoustic signal 37 and receiving acoustic signal 47. Both of these embodiments would use a pulse-echo technique similar to what was described in the text relating to FIGS. 8 and 9.

Figure 12:
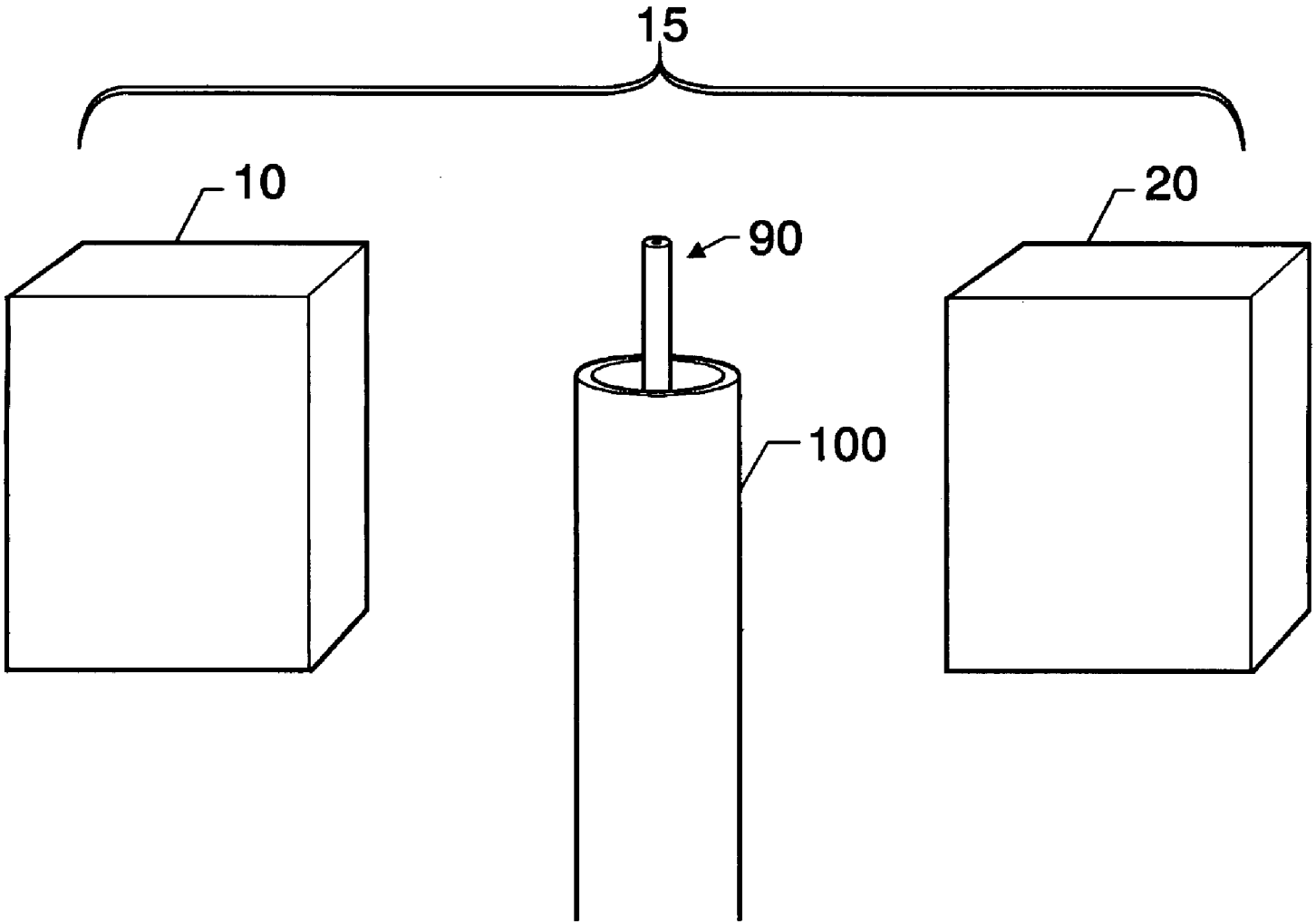
FIG. 12 is a simplified perspective view of a different embodiment of the compressing means.

The compressing means 15 need not be wedge-shaped. If the compressing members 10 and 20 are capable of deforming the crimp connector 100 about the wire 90, they are suitable for this embodiment. For example, FIG. 12 demonstrates the compressing means 15 with a flat or block shaped punch 10 and a flat or block-shaped anvil 20. Other contact surfaces such as round, jagged, triangular, etc. may also be used.

Figure 13:
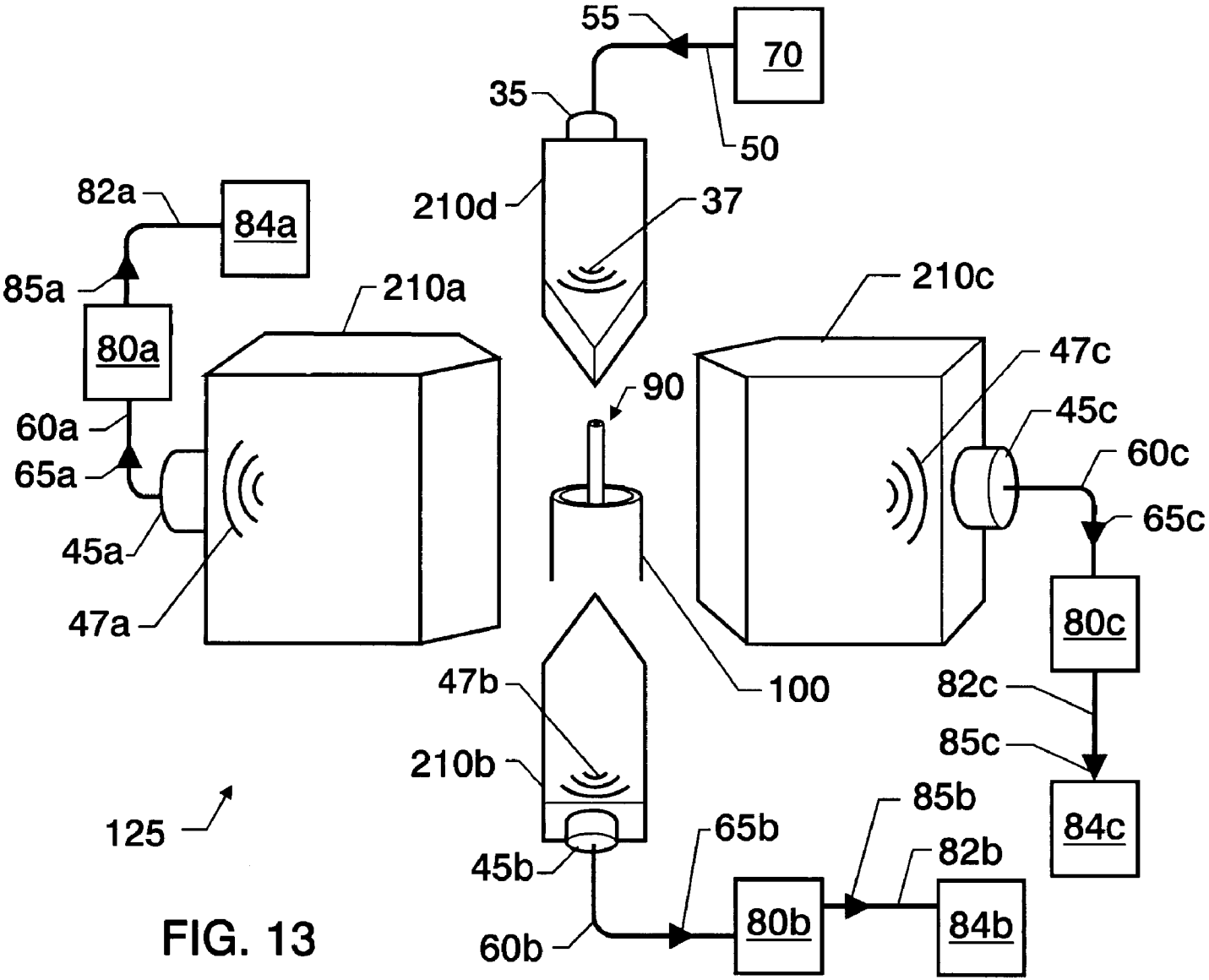
FIG. 13 is a simplified perspective view of an alternative compressing means and possible arrangements of the ultrasonic components and related circuitry.

Rather than the compressing means 15 comprising two bodies such as a punch and an anvil, the compressing means 15 may also comprise any number of compressing bodies. One example is a configuration that comprises four punches 210*a*, 210*b*, 210*c*, and 210*d* as illustrated in FIG. 13.

The four-punch system 125 is subject to the same variations in positioning of the transducer components discussed previously for system 25. FIG. 13 illustrates a system comparable to that described in FIGS. 4 and 5 where at least one transmitting transducer 35 sends an acoustic signal 37 to be received by multiple receiving transducers 45*a*–*c*. Each receiving transducer 45*a*–*c* then transduces the received acoustic signal 47*a*–*c* to an electrical signal 65*a*–*c* that is sent via the respective electrical connection 60*a*–*c* either to independent receiver circuitry 80*a*–*c* or to a central set of receiver circuitry 80 (not shown) to be analyzed and amplified before being sent via respective electrical connections 82*a*–*c* to displays 84*a*–*c*, or combined to be displayed on a single display 84 (not shown).

Figure 14:
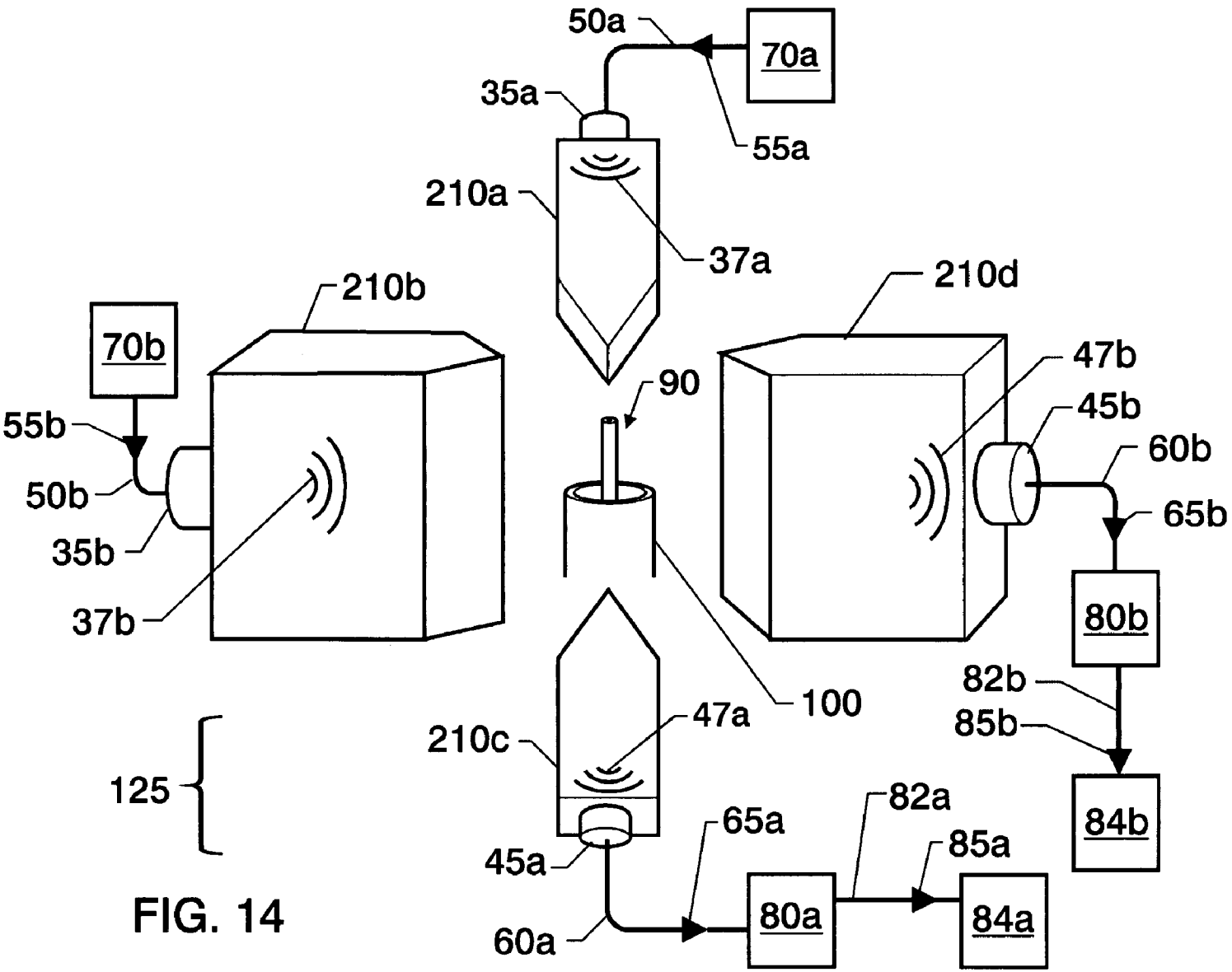
FIG. 14 is a simplified perspective view of a four-pronged compressing means and some possible arrangements of the ultrasonic components and related circuitry for another embodiment of the present invention.

Referring to FIG. 14, the four-punch system 125 may also be configured with two transmitting transducers 35*a*, 35*b* respectively positioned on two independent compressing members 210*a*, 210*b* and paired with two receiving transducers 45*a*, 45*b* respectively positioned on two compressing members opposite its respective transmitting transducers.

Figure 15:
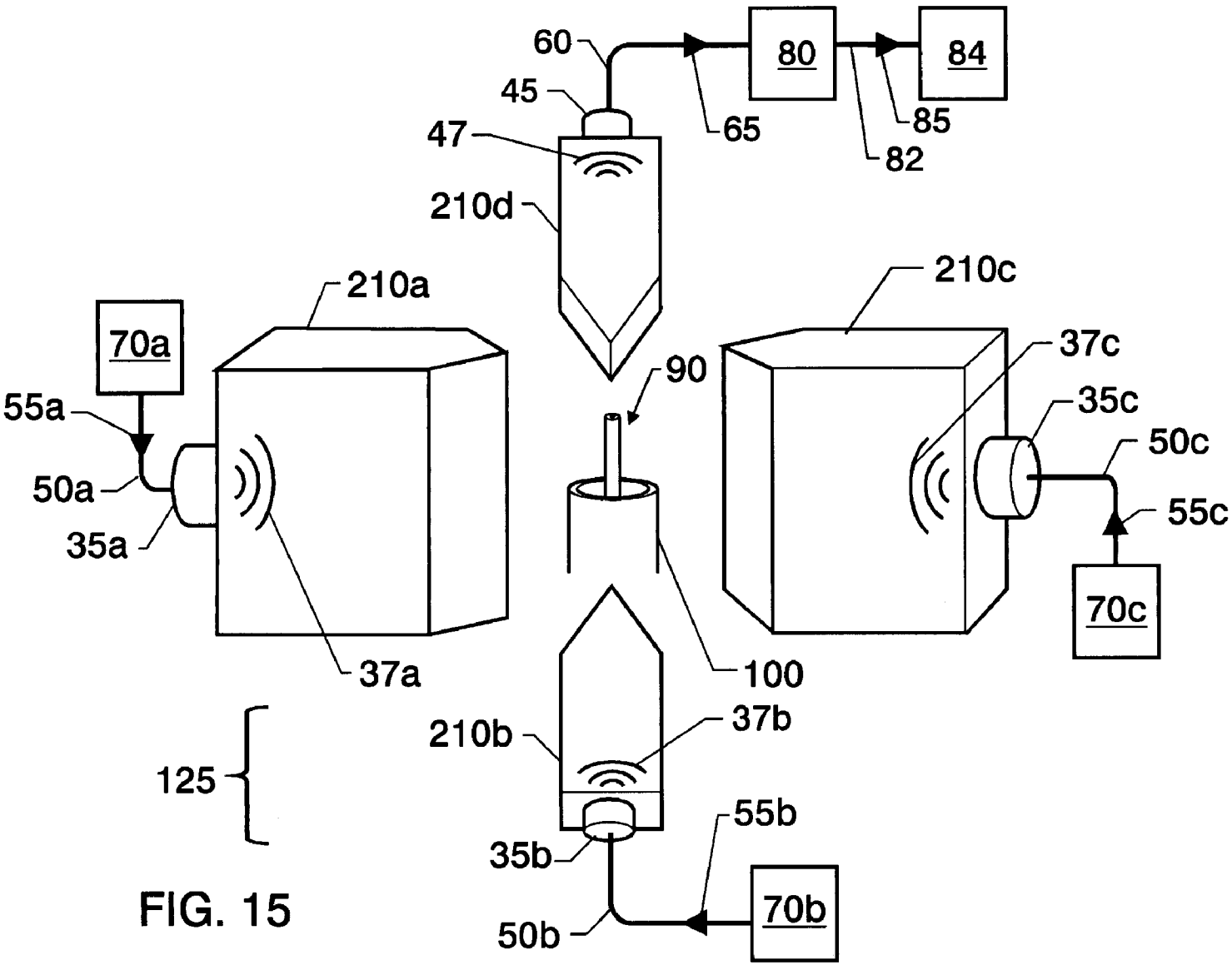
FIG. 15 is a simplified perspective view of the four-pronged compressing means and another alternative arrangement of the ultrasonic components and related circuitry.

The four-punch system 125 may also be configured with three transmitting transducer 35*a*, 35*b*, 35*c* respectively positioned on independent compressing members 210*a*,

210*b*, 210*c* and one receiving transducer 45 positioned on the remaining compressing member 210*d* as illustrated in FIG. 15.

Figure 16:
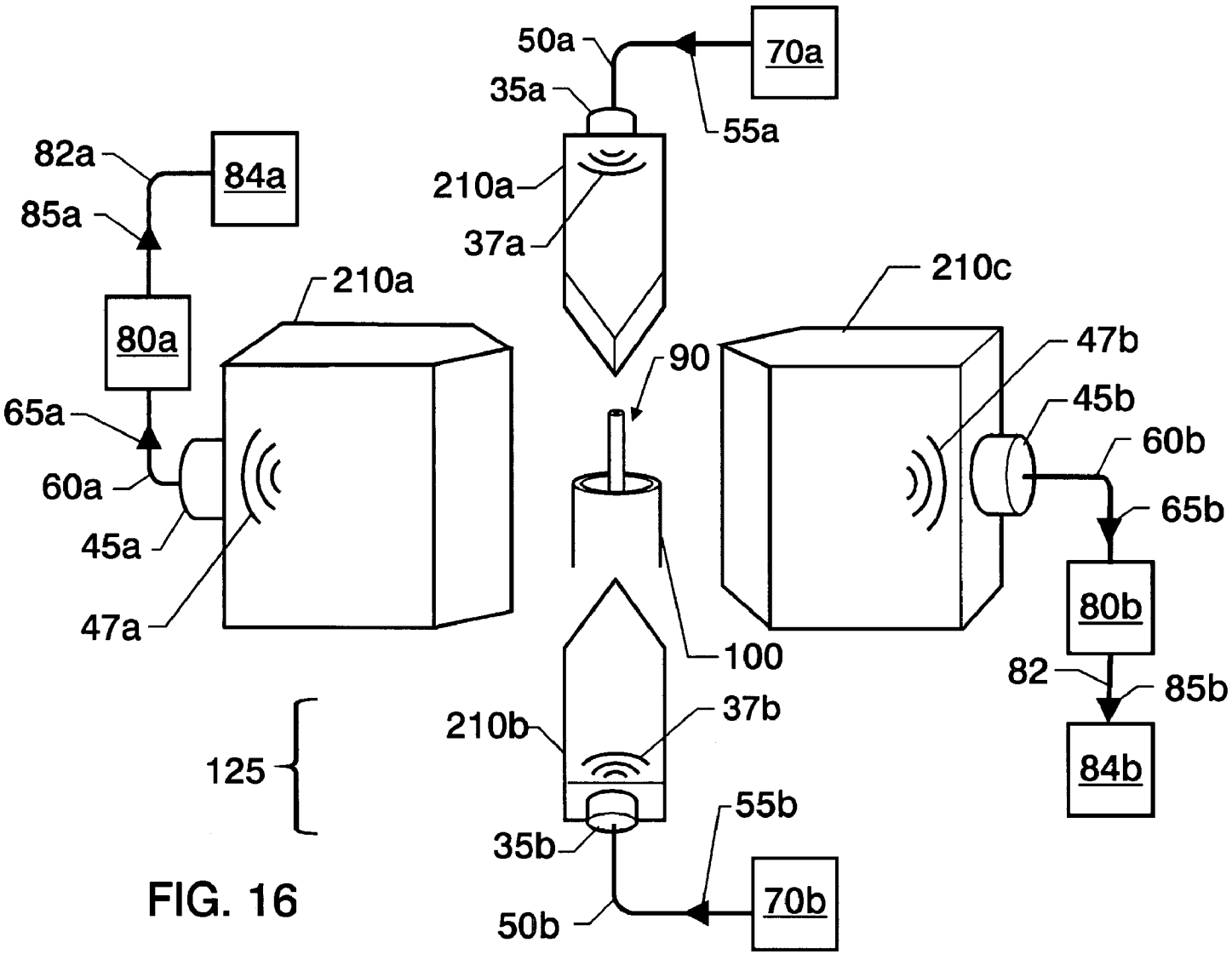
FIG. 16 is a simplified perspective view of the four-pronged compressing means and another alternative arrangement of the ultrasonic components and related circuitry.

Another embodiment of the four-punch system 125 is illustrated in FIG. 16. This embodiment is comparable to the system described for FIGS. 6 and 7 where the signal is sent transversely rather than longitudinally (in a straight line) through the crimp connection.

Figure 17:
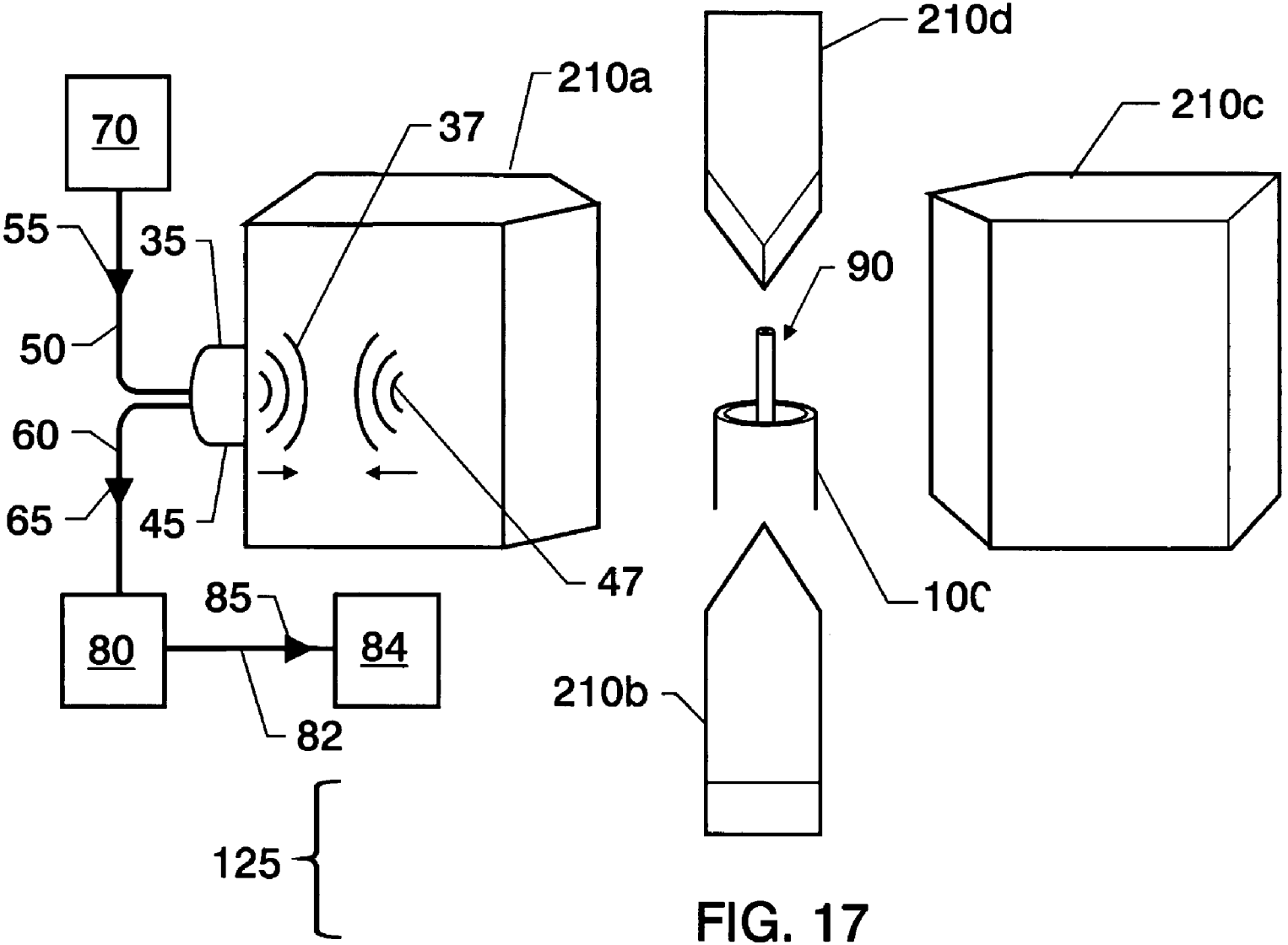
FIG. 17 is a simplified perspective view of the four-pronged compressing means and another alternative arrangement of the ultrasonic components and related circuitry.

The four-punch system 125 may use the pulse-echo technique displayed in FIG. 17, which operates in a manner similar to the systems of FIGS. 10 and 11 described previously.

Figure 18:
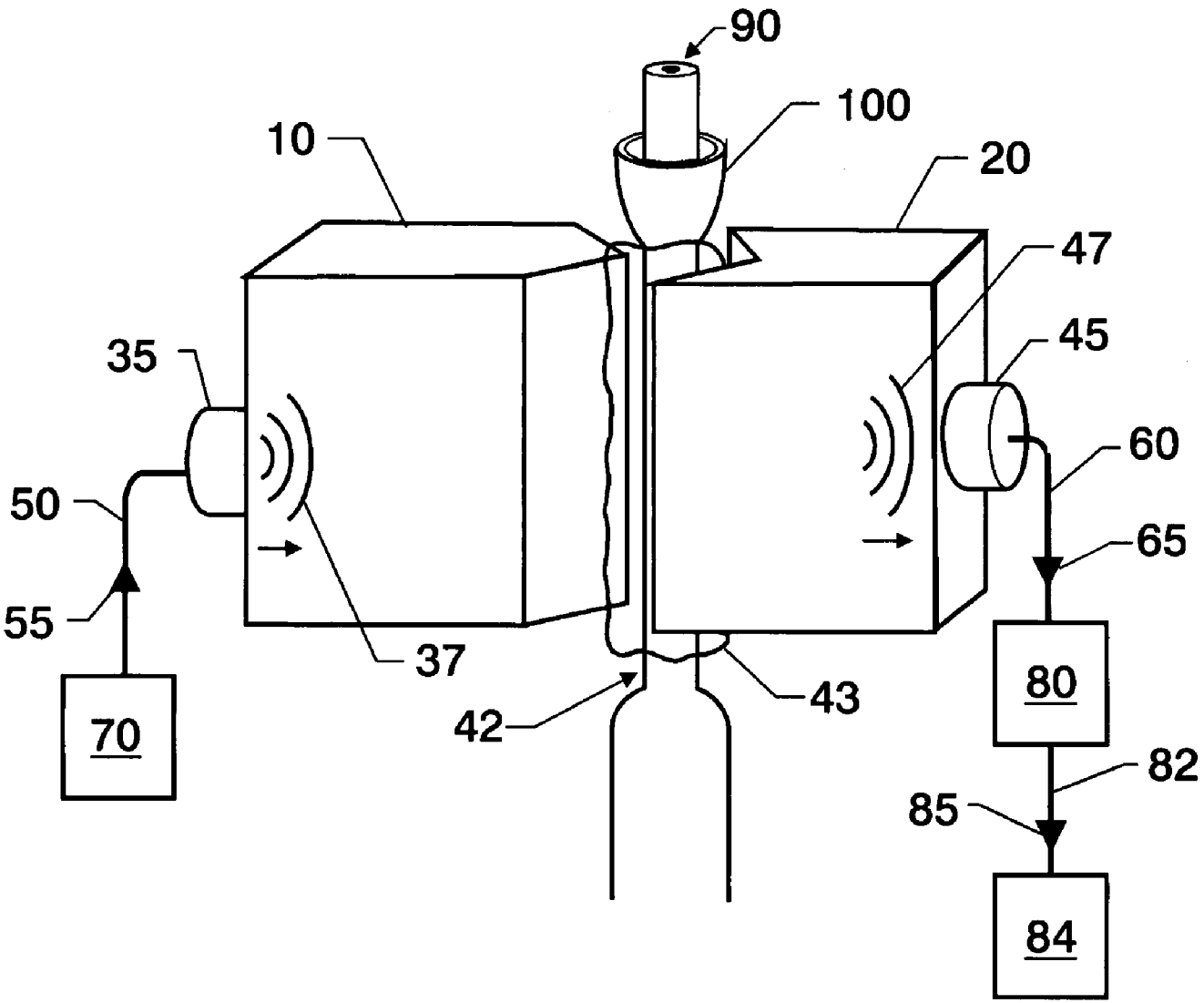
FIG. 18 is a perspective view of the compressing means showing the positioning of the device for use in recertification.

As illustrated in FIG. 18, an embodiment of this invention may also be used to recertify the desirability of a crimp connection after its formation. FIG. 18 shows the punch 10 and anvil 20 aligned with a deformation pattern 42 on the outer surface of the crimp connector 100. This deformation pattern is formed by the compressing means 15 during the initial crimping process. It may be a deep groove, a series of indentations, etc. An ultrasonic coupling agent 43 is applied to the outer surface of the deformed crimp connector 100. The punch 10 and anvil 20 are brought together in order to apply pressure to the deformed crimp connector 100 and wire 90, but not so much pressure that additional deformation occurs. An acoustic signal 37 is then sent by the transmitting transducer 35 through the punch 10, the crimp connector 100, the wire 90, out the other side of the crimp connector 100, and into the anvil 20. The acoustic signal 47 is received by a receiving transducer 45 and converted to an electrical signal 65. The electrical signal 65 may be compared with the signal received when the crimp connection was originally made. This comparison is accomplished via electrical circuitry 80, done manually by the operator, or a combination of the two.

In an alternative embodiment of use for recertification, the electrical signal 65 is compared with signals of crimp connections considered to be desirable through destructive testing.

A further embodiment uses a combination of these two techniques to verify the continuing desirability of the crimp connection.

While a system having a punch 10 and anvil 20 has been illustrated for use in recertification, the same process for recertification would apply for other configurations of the compressing means, such as, for example, a four-punch system.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function and step-plus-function clauses are intended to cover the structures or acts described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed as new and desired to be secured by Letters Patent of the United States is:

1. An apparatus comprising:

means for compressing a crimp connector about a body to form a crimp connection;

transducer means, ultrasonically coupled to said compressing means, said transducer means comprising at least one transmitting means for transducing electrical signals into acoustic signals for transmission through the crimp connector and at least one receiving means for receiving the acoustic signals sent through the crimp connector and transducing the received acoustic waves into electrical signals;

transmitter circuitry, electrically connected to said at least one transmitting means, for supplying electrical signals to said transducer; and receiver circuitry electrically connected to said at least one receiving mean, for processing the electrical signals generated by said at least one receiving means, wherein the processed electrical signals are indicative of the number of points of contact between said body and said crimp connector, said number of points of contact being indicative of the condition of said crimp correction being formed about said body.

2. An apparatus according to claim 1 wherein said compressing means comprises a punch and an anvil.

3. An apparatus according to claim 2 wherein said at least one transmitting means is ultrasonically coupled to said punch and said at least one receiving means is ultrasonically coupled to said anvil.

4. An apparatus according to claim 2 wherein said at least one transmitting means is ultrasonically coupled to said anvil and said at least one receiving means is ultrasonically coupled to said punch.

5. An apparatus according to claim 2 wherein said at least one transmitting means and said at least one receiving means are ultrasonically coupled to said anvil.

6. An apparatus according to claim 2 wherein said at least one transmitting means and said at least one receiving means are ultrasonically coupled to said punch.

7. An apparatus according to claim 1 wherein said compressing means comprises at least two compressing members.

8. An apparatus according to claim 1 wherein said compressing means comprises four punches.

9. An apparatus according to claim 7 wherein said at least one transmitting means is ultrasonically coupled to a first compressing member positioned substantially opposite, in relation to the position of the crimp connector, to a second compressing member, the second compressing member having said at least one receiving means ultrasonically coupled thereto.

10. An apparatus according to claim 7 wherein said at least one transmitting means is ultrasonically coupled to a first compressing member positioned substantially perpendicular, in relation to the location of the crimp connection, to a second compressing member, the second compressing member having said at least one receiving means ultrasonically coupled thereto.

11. An apparatus according to claim 7 wherein said at least one transmitting means and said at least one receiving means arc ultrasonically coupled to the same compressing member.

12. An apparatus according to claim 1 wherein said transducer means employs a pulse-echo technique.

13. An apparatus according to claim 1 wherein said processed electrical signals are sent to a display device.

14. An apparatus according to claim 13 wherein said display device communicates the electrical signal to the user visually.

15. An apparatus according to claim 14 wherein said display device is an oscilloscope.

16. An apparatus according to claim 14 wherein said display device is one of a cathode ray tube, a liquid crystal display, or a plasma screen.

17. An apparatus according to claim 14 wherein said display device comprises a green light if the crimp connection is desirable and a red light if the crimp connection is not desirable.

18. An apparatus according to claim 13 wherein said display device communicates the electrical signal to the user aurally.

19. An apparatus according to claim 13 wherein said display device communicates the electrical signal to the user tactilely.

20. A method of using a crimping tool comprising the steps of:

ultrasonically coupling a transducer means to a means for compressing a crimp connector;

sending an electric signal to said transducer means;

transducing the electric signal into an acoustic signal;

transmitting said acoustic signal through said compressing means to the crimp connector;

receiving the acoustic signal transmitted through the crimp connection;

transducing the received acoustic signal into a second electric signal;

processing the second signal, wherein said processed signal is indicative of the number of points of contact between a body and said crimp connector, said number of points of contact being indicative of the condition of said crimp connection; and communicating said second electric signal to an operator of the crimping tool.

21. A method according to claim 20 wherein said compressing means comprises a punch and an anvil.

22. A method according to claim 20 wherein said compressing means comprises a plurality of punches.

23. A method according to claim 20 wherein said compressing means comprises a plurality of anvils.

24. A method according to claim 20 wherein said transducer means uses a pitch-catch technique for the steps of transmitting the acoustic signal and of receiving the acoustic signal.

25. A method according to claim 20 wherein said transducer means uses a pulse-echo technique for the steps of transmitting the acoustic signal and of receiving the acoustic signal.

26. A method of recertifying the desirability of a previously formed crimp connection made by a crimping tool, comprising the steps of:

ultrasonically coupling a transducer means to a means for compressing a crimp connector;

aligning said compressing means with the deformation pattern of the previously formed crimp connection;

constricting said compressing means about a deformed crimp connector;

sending an electrical signal to said transducer means;

transducing the electrical signal into an acoustic signal;

transmitting said acoustic signal through said compressing means to the previously formed crimp connection;

receiving the transmitted acoustic signal;

transducing the received acoustic signal into a second electrical signal;

processing the second electrical signal; and communicating said second electrical signal to an operator of the crimping tool determining desirability of the previously formed crimp connection.

27. A method according to claim 26 wherein said step of constricting enables the compressing means to be in physical contact with the previously formed crimp connection but does not result in further deformation of the deformed crimp connector.

* * * * *